US005725008A

United States Patent [19]

Johnson

[11] Patent Number: 5,725,008

[45] Date of Patent: Mar. 10, 1998

[54] REINFORCING MEMBER ATTACHED TO A SINK AT A PLACE OF INSTALLATION OF A FAUCET SET

[76] Inventor: Floyd M. Johnson, 1726 E. Iowa Ave., St. Paul, Minn. 55106

[21] Appl. No.: 660,224

[22] Filed: Jun. 3, 1996

[51] Int. Cl.[6] ..... F16K 11/10

[52] U.S. Cl. ..... 137/15; 137/356; 137/359; 137/801; 4/878

[58] Field of Search ..... 137/801, 356, 137/359, 15; 4/878

[56] References Cited

U.S. PATENT DOCUMENTS

| | | | |
|---|---|---|---|
| 2,258,044 | 10/1941 | Chesney | 4/170 |
| 2,584,107 | 2/1952 | Beam | 4/170 |
| 3,009,167 | 11/1961 | Leonard, Jr. | 4/191 |
| 3,785,396 | 1/1974 | Morris et al. | 137/359 |
| 4,290,445 | 9/1981 | Turner | 137/359 |
| 4,356,574 | 11/1982 | Johnson | 4/192 |
| 4,502,165 | 3/1985 | Szemeredi et al. | 4/192 |
| 4,649,958 | 3/1987 | Purcell | 137/801 |
| 4,922,554 | 5/1990 | Hwang | 4/191 |
| 5,165,121 | 11/1992 | McTargett et al. | 4/678 |
| 5,375,272 | 12/1994 | Mikol | 4/695 |
| 5,518,016 | 5/1996 | Sharwark | 137/359 |

*Primary Examiner*—A. Michael Chambers

*Attorney, Agent, or Firm*—Merchant, Gould, Smith, Edell, Welter & Schmidt, P.A.

[57] ABSTRACT

A faucet assembly including a resilient reinforcing member that ensures the faucet set compresses a sealing gasket to prevent leaks. The faucet set is secured to the deck or mounting flange of a sink from below the sink using winged nuts that can fasten the faucet set to the sink mounting location using threaded members. A gasket fits between the top of the sink mounting flange and the bottom of the faucet set. On the opposite side of the sink flange mounting location for the faucet set, a resilient stiffener is placed that contains apertures through which the mounting threaded members extend. The winged nuts are threaded onto the threaded members compressing the resilient reinforcing member. The resiliency and modulus of the reinforcing member ensures that the gasket is compressed by the faucet set even if some stress is applied during use of the faucet set no gap appears between the faucet set, the gasket and the sink. The resilient reinforcing member comprises a material that has sufficient stiffness to ensure the gasket remains compressed over the lifetime of the unit. The preferred resilient member is not coplanar. The resilient member departs from planarity at the ends of the member such that the ends depart from planarity by an angle α. This angle ensures that the faucet set is pulled against and compresses the gasket during the life of the installation on the sink.

34 Claims, 2 Drawing Sheets

FIG.1
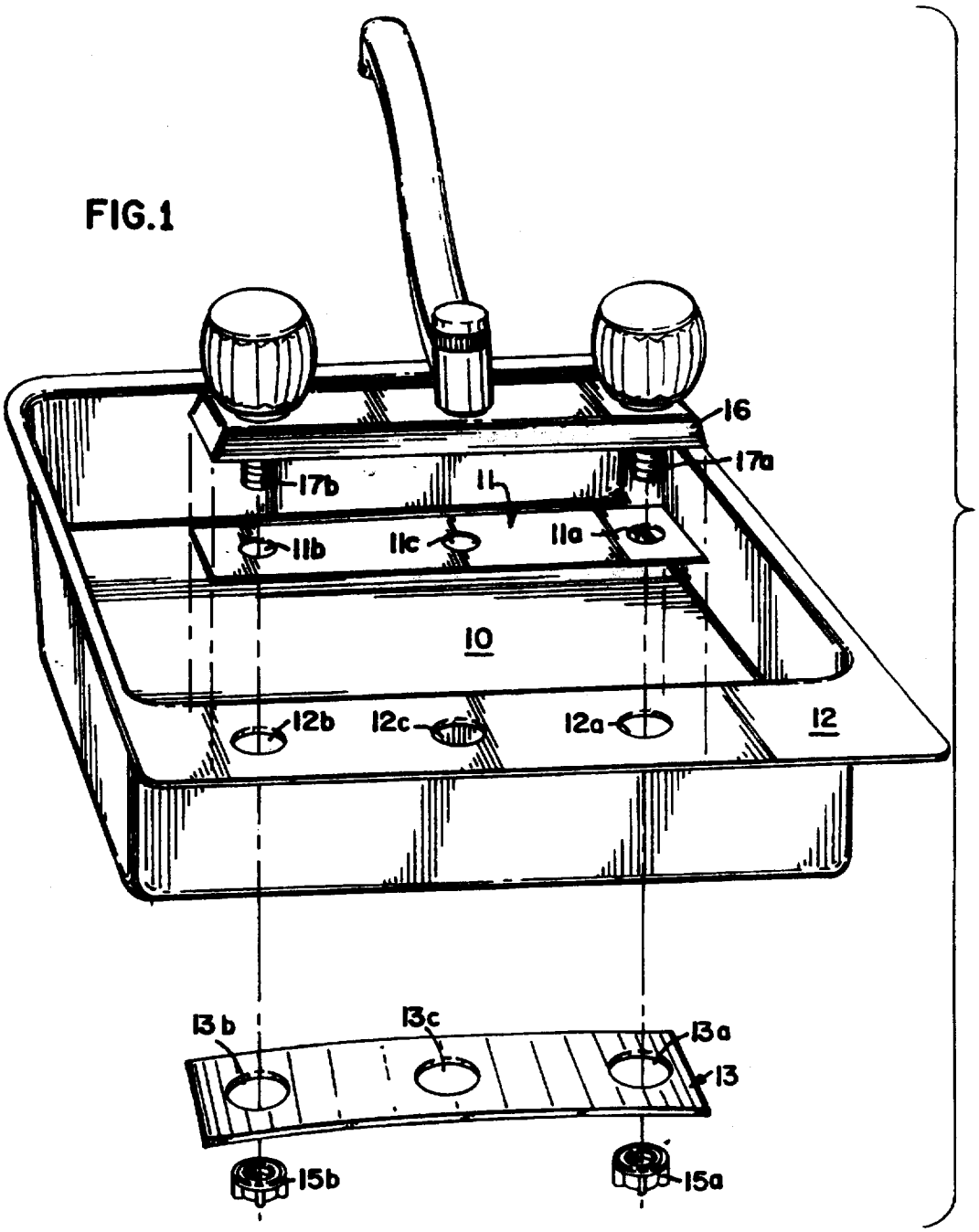
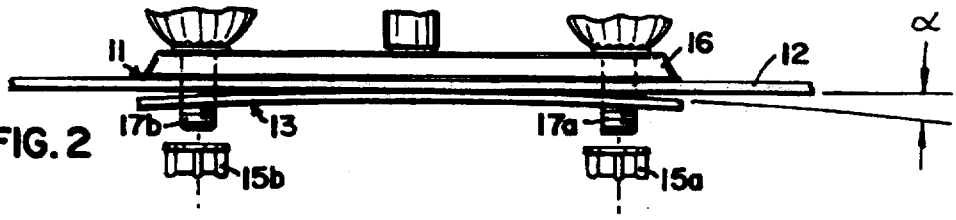
FIG. 2

REINFORCING MEMBER ATTACHED TO A SINK AT A PLACE OF INSTALLATION OF A FAUCET SET

FIELD OF THE INVENTION

The invention relates to hardware associated with a secure, leak-free installation of a faucet set comprising valves and a spout used for the delivery of service water from a water utility.

BACKGROUND OF THE INVENTION

Sinks have been installed in household and commercial kitchens, laundries, photography darkrooms, hospitals, etc. for many years. Sinks commonly have one or more bowl portions to contain water or other liquid and a flat, generally horizontal mounting flange portion around the periphery of the upper portion of the sink assembly. Such flanges often interact with a countertop and hold the sink in place. Additionally, in the mounting flange, two holes (FIG. 1 holes 12*a*, 12*b*) having a diameter of about 1.5 inches on about sink centers are commonly formed for installation of a faucet set having separate hot and cold service. Such faucet sets at a minimum, comprise one valve each for hot and cold water and a spout conveying hot, cold or mixed hot/cold water into the sink or bowl. Such mounting flanges typically also have a central hole (see FIG. 1, hole 12*c*) midway between the hot and cold service holes. The faucet can also contain other optional components that if present must be dealt with in installation. The faucet set is mounted on the flange typically using a sealing or leak preventing gasket between the flange and the faucet set base. The faucet set is held in place by wing nuts threaded onto a threaded mating surface on both the hot and cold water intake ports. As the nuts are tightened, the gasket is compressed. Such a gasket is designed to seal the joint between the faucet set and the flange to ensure that no water can leak through the mounting holes into the space below the sink. Any such water leak can cause rust in ferrous metal members and can ruin any item stored below the sink and can cause rot or other disintegration of wooden members in the counter assembly.

The faucet set as installed is secure against leaks through the seal formed by the gasket. However, when in use, water can begin to leak through the portion of the faucet set or sink even when a flange is used. Such leaks occur because, as the faucet, spout and valves are manipulated, the sink mounting flange can flex. Such flexing can cause a gap to appear between the faucet set and gasket and can cause a second gap between the gasket and sink flange. Such a flexed flange can provide one or more paths for water to leak from the sink region into the cabinetry below the sink. Such loosening of the faucet set is more common in sinks having a relatively thin gauge metal ((i.e.)typically 23–20 gauge, about 0.7 mm to 0.9 mm, stainless steel) in the flange because flex in the flange occurs to a greater degree in thin gauge metal. More robust sinks made of thicker gauge material (20–17 gauge, about 1.0 mm to 1.5 mm) are somewhat more resistant to flex generated water leaks. However, any sink location depending on use and installation can have substantial loosening and leak occurrence depending on timing and severity of use.

Accordingly, a substantial need exists to provide a sink flange stiffener device that can reduce the tendency of such faucet set installations on sink flanges to leak when installed on flexible flanges.

BRIEF DISCUSSION OF THE INVENTION

I have found a novel stiffener that can make an installation of a faucet set to mounting flange, using a gasket, more flex resistant and more secure against leaks. The stiffener is a sheet-like arcuate resilient member having a central point and ends that depart from planarity with the central point by less than 5° preferably less than 2°, preferably less than 1.8°. The stiffener is installed opposite to the faucet set and gasket on the sink flange by securing the stiffener with the nuts. The stiffener generally has a mounting hole for each of the hot and cold water intake ports. These holes in the stiffener and the stiffener surfaces are generally non-coplanar. In other words, the stiffener can be curved or can have a flat portion of the stiffener fixed at an angle to the other generally flat portion. The preferred stiffener typically has dimensions of about 2 to about 2.5 inches in width, 11 to 12 inches in length and about ⅛ to ⅜ inches in thickness depending on material and modulus.

The stiffener device of this invention should have sufficient stiffness to prevent the localized flexing around the faucet set that causes leakage. In other words when installed, the stiffener stabilizes the sink installation flange as the faucet set valves and spout are manipulated. The flange flexes so low, when stiffened by the object of the invention, that no leakage occurs. Said stiffness results from the resiliency or modulus of the material from which the stiffener is made. Further the degree of flex depends on the gauge of the stainless steel sink flange. Relatively thin gauged steel requires a significant stiffener while thicker steel flanges can be maintained leak free with a less thick stiffener depending on period and severity of use. In certain application, a stiffener with a modulus of less than 100,000 psi is acceptable. However, any modulus between 100,000 and 1.5 million psi may be required for complete leak prevention. Preferred sink stiffeners have a modulus of greater than 200,000 and preferably greater than 300,000 psi. The thickness of the stiffener depends on the modulus and the material from which it is made. Accordingly a stainless steel stiffener can have a relatively narrow thickness when compared to a stiffener with the same modulus prepared from an acrylic material. A modulus of 100,000 and a stainless steel member can be achieved with a substantially less thick part when compared to an acrylic stiffener.

The edges of this stiffener can also comprise a reinforcing member or reinforcing means. Such reinforcing means can be introduced in the initial shaping of the stiffener. Alternatively, the reinforcing means can comprise separate ribs, bars or other reinforcing members on any portion of the stiffener, commonly the edge of the stiffener length. An important aspect of this stiffener is its portions that are non-coplanar with respect to other portions of the stiffener. This lack of coplanarity that when installed the stiffener is placed under stress resulting in a substantial strain. In a preflexed installation, the winged nuts compress the non-coplanar stiffener, during assembly of the stiffener, gasket and faucet set, against the sink installation flange and holes. This stiffener both increases the resistance of the mounting flange to flex under use and further ensures that the gasket remains compressed even if the faucet set is abused in use. Such a configuration increases the likelihood that the seal will be maintained during use.

The stiffener is generally configured to conform to the shape of the mounting location in the flange. However, the stiffener is non-planar. In other words, the stiffener ends depart from planarity through angle $\alpha$ which is less than 5°, typically $\alpha$ is less than 2° preferably less than 1.8°. When installed on the mounting flange, the angle $\alpha$ exists, in a stress-free preinstallation configuration prior to fastening of the stiffener in place, between the ends of the stiffener and the sink flange surface. In other words, as the non-planar stiffener is installed onto the threaded members that fix the faucet set in place, the center of the stiffener contacts the bottom of the flange portion but the stiffener forms an angle between the end of the stiffener portion and the underlying surface of the sink flange of less than about 5° but with a sufficient angle such that when tightened, the stiffness of the reinforcing member causes the faucet set to compress the installation gasket to prevent leaks. When compressed the stiffener attains a stressed substantially coplanar installation configuration.

BRIEF DISCUSSION OF THE DRAWINGS

FIG. 1 is a perspective isometric exploded view of the assembly of the faucet set, the sealing gasket between the faucet set and the sink installation flange, the sink installation flange including mounting holes, the stiffener component and the winged nuts that interact with the threaded portions on the faucet set to fix the faucet set in place.

FIG. 2 shows a side view of a stiffener in place before tightening winged nuts. In the view, the non-coplanar nature of the stiffener that promotes a water tight, leak free installation of the faucet set and gasket. An angle $\alpha$ is shown present in the stiffener prior to tightening.

FIG. 3 shows a transparent, plastic (acrylic) embodiment of the stiffener of the invention including stiffener bars on the side opposite the installation surface.

DETAILED DESCRIPTION OF THE INVENTION

Figure 3:
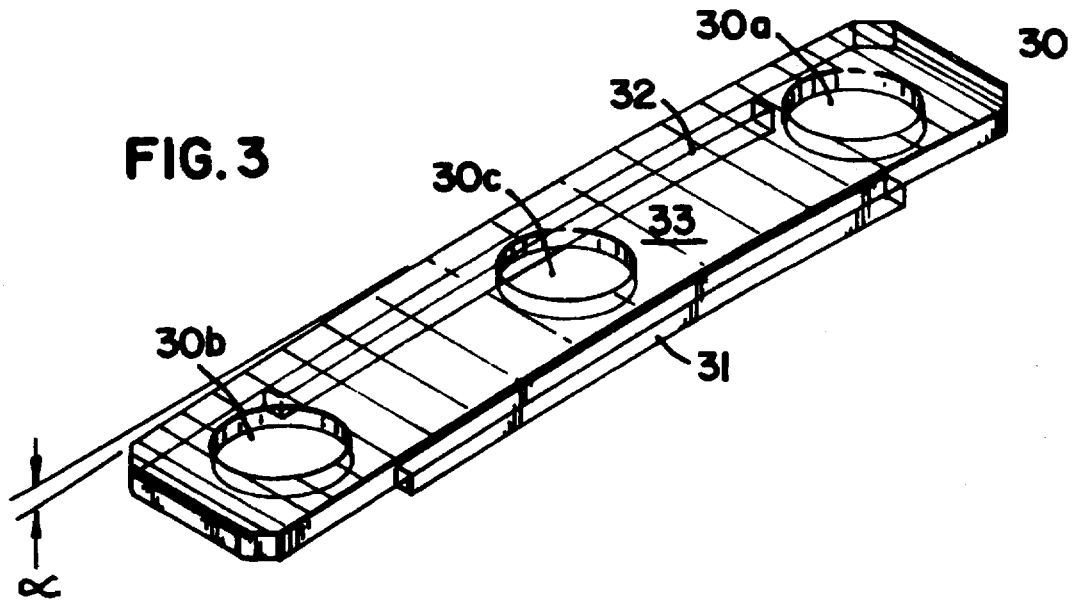

As shown in FIG. 1 the stiffener in 13 is installed onto a sink mounting flange 12 opposite gasket 11 and faucet set 16. In the embodiment shown in FIG. 1, an arcuate member is shown which draws the faucet set in a sealing configuration against the gasket. As installation nuts 15*a* and 15*b* are tightened, the stiffener 13 in an arcuate preinstallation configuration is compressed using the installation nuts 15*a* and 15*b* into a substantially planar installation configuration. The stress on the arcuate member produces a resulting strain and its planar installation configuration that ensures that the faucet set compresses the gasket under typical use conditions of operating the faucet set valves and spigot. The mechanism of action of the stiffener of the invention results from stressing a non-planar stiffener producing a resultant strain in the stiffener that prevents the faucet set installation flange as the stiffener from any flex during use which can cause leakage through the faucet set gasket seal. With this mechanism in mind, it should be relatively apparent that any configuration of these stiffener configure to the two or three hole sink flange installation site with a typical faucet set can be used. The stiffener is typically a sheet-like member having an arcuate shape, and internal angle or angles, offset portions, etc. which produces a stress in response to a strain generated by installing the stiffener in the sink installation. We believe that any stiffener of the invention will have a preinstallation configuration and an installation configuration. The preinstallation configuration will depart from planarity to some degree. As the stiffener is installed and the installation nuts are tightened, the stiffener will obtain an installation configuration different than the preinstallation configuration that results in a substantial stress/strain reaction producing increased flex resistance.

In a preferred configuration, these stiffeners are sheet-like material having a smooth arcuate curve that becomes coplanar as it reaches its installation configuration. A second embodiment is a sheet-like member having an internal angle at its center location such that the internal angle separates two planar stiffener portions. At installation, the internal angle approaches 180° leaving both portions of the stiffener in a coplanar installation configuration. A variety of other configurations can be envisioned including two or more angle portions, offset plateaus in the stiffener or virtually any other non-planar aspect wherein a portion of the stiffener is non-planar with another portion of the stiffener and such lack of planarity permits the stress/strain reaction leading to improved resistance to flex after installation.

Such a stiffener requires material having sufficient modulus (stiffness or resiliency) such that the installation of the stiffener results in the permanent stress/strain relationship. The material should not colt slow such that the stress is relieved permitting flex and promoting leakage.

To a degree, virtually any solid material can be configured into a stiffener in the invention. However, an efficiently manufactured stiffener will have a thickness of less than about 0.25 inches. Such a dimension requires a substantial modulus. Virtually any material can be used in the stiffener of the invention if it has a modulus of greater than about 100 thousand and preferably greater than 200 thousand. Materials that can be used in the stiffener include sheet aluminum, cast aluminum, sheet steel, stainless steel, thermoplastic fiber composites, thermoplastic sheet, reinforced thermoplastic sheet, and other well known materials. The typical installation involves mounting apertures in the sink flange, gasket and stiffener that are similar in size. Any substantial departure from appropriate size will reduce its utility. The mounting aperture typically conformed to the threaded water intake ports of the faucet set. Accordingly the mounting apertures must be at least as big as the water inlet ports such that the water inlet port can pass through the apertures in the gasket, sink flange and stiffener. Typically the holes have a dimension of greater than about 1.25 inches preferably greater than about 1.5 inches. The hole corresponding to the hot and cold water inlet ports are typically formed at about 7 to 9 inches on center preferable 8 inches on center for a typical installation. Often a third mounting aperture is created in the sink flange and stiffener to permit single handed faucet set utility. The central mounting aperture is typically equidistant between hot and cold water inlet apertures.

In the preferred embodiments of the mentioned, comprising a sheet-like arcuate member or a sheet-like member having a single included angle at the center of the member, the ends of the members depart from planarity, when the member is compared to a horizontal surface, wherein each end is separated from the horizontal surface by an angle of less than about 2°. Both the arcuate member and the member having a single end closed angle when compared to a horizontal surface will have such an angle at each end of the member compared to the horizontal surface.

In FIG. 1 a typical stainless steel sink 12 is shown with mounting holes 12*a*, 12*b* and 12*c* shown in the mounting flange. Such stainless steel sinks are typically stamped from stainless steel sheet having a gauge of about 16 to 24. Typical heavy duty sinks are manufactured from a sheet steel having a gauge of about 17 to about 20. Lighter duty, less expensive sinks typically have a gauge that is about 20 to 24. Such lighter, less expensive sinks are more likely to leak through the installation gasket because lighter gauge stainless steel is more subject to flexing during use.

The faucet sets referred to in the application are of standard faucet sets manufactured using a particular configuration of components utilized by virtually all faucet set manufacturers. Such faucet sets are installed in sink applications using hot and cold water inlet ports which act not only as connections to the service water but also act to fix the faucet set in place on the flange using exterior threaded connectors. Such external threaded connectors cooperate with installation nuts that fix the faucet set in place. The water inlet ports are also internally threaded or adapted to the service water inlet pipes.

Such faucet sets are typically installed using an installation gasket. The installation gasket typically follows the shape or profile of the faucet set footprint on the sink installation flange. The gaskets have apertures matching faucet set water inlet ports. Gaskets are commonly made from a resilient sheet-like material such as rubber, neoprene, polyurethane, etc. Such gaskets require compression during installation for leak prevention. As the installation nuts are tightened on the hot and cold water inlet ports, the faucet set compresses the gasket. The resiliency of the gasket permits compression and sealing. The stiffener of the invention cooperates with the sink installation flange, the gasket and the faucet set to prevent leaks during use.

DETAILED DESCRIPTION OF THE DRAWINGS

FIG. 1 shows a sink 10 with an installation flange 12 having mounting holes 12*a*, 12*b* and 12*c*. In the installation of the faucet set 16, a sealing gasket 11 is placed on the mounting flange 12 with flange holes 11*a*, 11*b* and 11*c* registered with the sink mounting holes 12*a*, 12*b* and 12*c*. The faucet set 16 having threaded water inlet portions 17*a* and 17*b* are directed through the gasket and installation flange holes. In typical installations, the gasket 11 seals the faucet set making the installation water tight and prevents water leaking from the exterior or top portion of the installation flange underneath the sink. Such leaking can cause both metal rusting and rot of wooden sink members. The stiffener 13 having mounting aperture holes 13*a*, 13*b* and 13*c* is installed having the threaded portions 17*a* and 17*b* extending through holes 13*a* and 13*b*. The installation is completed by threading winged nuts 15*a* and 15*b* onto the threaded portions. As the winged nuts are drawn along the threaded portion of 17*a* and 17*b*, the winged nuts come into contact with the stiffener 13. The degree to which the stiffener departs from a coplanar format provides a stiffening and sealing function. The winged nuts 15*a* and 15*b* contact the surface of the stiffener 13 and as they tighten, force the stiffener against the installation flange 12 creating strain in the stiffener. Such strain ensures that the faucet set 16 is forced against the gasket 11 even if the winged nuts 15*a* and 15*b* are loosened during use. The winged nuts 15*a* and 15*b* must be loosened significantly before the gasket is no longer compressed in a sealing fashion. As long as some compression of the gasket by the assembly occurs, the installation remains water tight and no water leaks below the sink.

In FIGS. 1 and 2, stiffener 13 is manufactured from a high modulus material including stainless steel, cast aluminum, sheet thermoplastic, etc.

FIG. 3 is a stiffener of the invention manufactured from a thermoplastic resin material. FIG. 3 shows a transparent acrylic, polystyrene or polyester material. Such engineering plastics typically have a modulus substantially less than metal, stiffener elements 31 and 32 are introduced onto the side of the stiffener opposite to the installation flange mounting surface 33. In similar fashion to the stiffener shown in FIGS. 1 and 2, the stiffener is installed with the faucet set by introducing the threaded portions 17*a* and 17*b* through holes 30*a* and 30*b*. FIG. 2 additionally shows the angle $\alpha$ that demonstrates the non-coplanar nature of the stiffener device. This non-coplanar nature when under stress introduces a strain into the assembly that ensures the mounting gasket is compressed by the faucet set preventing water leakage.

I claim:

1. A method to install a faucet set on a planar stainless steel sink mounting flange using a sealing gasket, the method comprising:

(a) placing a faucet set having at least a hot and a cold water inlet and a gasket having mounting apertures conforming to the hot and cold inlets, on an installation flange of a sink, of said sink mounting flange having apertures conforming to the faucet set water inlet ports, on the sink mounting flange, said gasket forming a seal between the faucet set and the flange;

(b) placing a sheet-like resilient member having a center and adapted to the installation of the faucet set using the threaded inlets, the member having a first uninstalled configuration and a second installed configuration, wherein in the first uninstalled configuration the resilient member comprising opposite arcuate ends such that the member symmetrically departs from planarity from the center to each end of the resilient member by an intentionally introduced angle of less than 5°, and wherein in the installed configuration, the sheet-like member becomes substantially planar, the planarity caused by securing the ends of the member to the planar mounting flange, wherein the member and its stress compresses the gasket to prevent leaks;

(c) introducing installation hardware onto the threaded water inlet ports in such a way as to introduce stress in the resilient member resulting in a strain in the resilient member that compresses the gasket.

2. The method of claim 1 wherein the member includes a third center aperture formed at the center of the member.

3. The method of claim 2 wherein each mounting aperture has a diameter of about 1.5 inches for the member of claim 1 wherein the angle is less than about 2°.

4. The method of claim 3 wherein the angle is less than about 1.5°.

5. The method of claim 4 wherein the center aperture is equidistant from the other circular mounting apertures.

6. The method of claim 1 wherein the member comprises aluminum and the member has a modulus of greater than about 100,000 psi.

7. The method of claim 1 wherein the member comprises of steel and the member has a modulus of greater than about 100,000 psi.

8. The method of claim 1 wherein the member comprises a polyacrylic polymer material and the member has a modulus of greater than about 100,000 psi.

9. The method of claim 1 wherein the member comprises aluminum having a thickness of about 2–8 mm.

10. The method of claim 1 wherein the member comprises steel having a thickness of about 2–6 mm.

11. The method of claim 1 wherein the member comprises a polyacrylic polymer material having a thickness of 4–10 mm.

12. A sheet-like arcuate member having a center and a length of about 11 to 12 inches and a width of about 2.25 to 2.5 inches, the member including at least two circular mounting apertures separated by a distance of about 7 to 9 inches, each aperture having a diameter of about 1 to 2 inches, wherein such arcuate member comprises opposite arcuate ends such that the member symmetrically departs from planarity from the center to each end of the arcuate member by an intentionally introduced angle of less than about 5° such that the departure from planarity of the member is symmetric about the center.

13. The member of claim 1 wherein the member includes a third aperture formed at the center of the member.

14. A member of claim 1 wherein each aperture has a diameter of about 1.5 inches for the member of claim 1 wherein the angle is less than about 2°.

15. The member of claim 14 wherein the angle is less than about 1.5°.

16. The member of claim 15 wherein the center aperture is equidistant from the other circular mounting apertures.

17. The member of claim 1 wherein the member comprises aluminum and the member has a modulus of greater than about 100,000 psi.

18. The member of claim 1 wherein the member comprises of steel and the member has a modulus of greater than about 100,000 psi.

19. The member of claim 1 wherein the member comprises a polyacrylic polymer material and the member has a modulus of greater than about 100,000 psi.

20. The member of claim 1 wherein the member comprises aluminum having a thickness of about 2–8 mm.

21. The member of claim 1 wherein the member comprises steel having a thickness of about 2–6 mm.

22. The member of claim 1 wherein the member comprises a polyacrylic polymer material having a thickness of 4–10 mm.

23. A faucet set installation kit that can be installed in a planar stainless steel sink mounting flange installation, said faucet set comprising:

(a) a body with a hot water valve, a cold water valve and a spigot, each valve in a fluid communication with a threaded water inlet said inlets spared on about 8 inch center;

(b) an installation gasket having aperture matching the threaded water inlets; and (c) an arcuate sheet-like resilient member having a center and adapted to the installation of the faucet set using the threaded inlets, the member having a first uninstalled configuration and a second installed configuration, wherein in the first uninstalled configuration the resilient member comprises opposite arcuate ends such that the member symmetrically departs from planarity from the center to each end of the resilient member by an intentionally introduced angle of less than 5°, and wherein in the installed configuration, the sheet-like member becomes substantially planar, the planarity caused by securing the ends of the member to the planar mounting flange, wherein the member compresses the gasket to prevent leaks.

24. The kit of claim 23 wherein the member includes a center third aperture formed at the center of the member.

25. A kit of claim 23 wherein each mounting aperture has a diameter of about 1.5 inches for the member of claim 12 wherein the angle is less than about 2°.

26. The kit of claim 25 wherein the angle is less than about 1.5°.

27. The kit of claim 26 wherein the center aperture is equidistant from the other circular mounting apertures.

28. The kit of claim 23 wherein the member comprises aluminum and the member has a modulus of greater than about 100,000 psi.

29. The kit of claim 23 wherein the member comprises of steel and the member has a modulus of greater than about 100,000 psi.

30. The kit of claim 23 wherein the member comprises a polyacrylic polymer material and the member has a modulus of greater than about 100,000 psi.

31. The kit of claim 23 wherein the member comprises aluminum having a thickness of about 2–8 mm.

32. The kit of claim 23 wherein the member comprises steel having a thickness of about 2–6 mm.

33. The kit of claim 23 wherein the member comprises a polyacrylic polymer material having a thickness of 4–10 mm.

34. The kit of claim 23 wherein the arcuate sheet-like resilient member comprises an arcuate member having a length of 11 to 12 inches, a width of about 2.25 to 2.5 inches, the member including at least two circular mounting apertures separated by a distance of about 7 to 9 inches, each aperture having a diameter of about 1 to 2 inches.

* * * * *